US012180871B1

(12) United States Patent
Minokoshi

(10) Patent No.: US 12,180,871 B1
(45) Date of Patent: Dec. 31, 2024

(54) EXHAUST GAS PURIFICATION DEVICE

(71) Applicant: SUBARU CORPORATION, Tokyo (JP)

(72) Inventor: Hiroyuki Minokoshi, Tokyo (JP)

(73) Assignee: SUBARU CORPORATION, Tokyo (JP)

( * ) Notice: Subject to any disclaimer, the term of this patent is extended or adjusted under 35 U.S.C. 154(b) by 0 days.

(21) Appl. No.: 18/717,254

(22) PCT Filed: Nov. 14, 2022

(86) PCT No.: PCT/JP2022/042260

§ 371 (c)(1),
(2) Date: Jun. 6, 2024

(87) PCT Pub. No.: WO2024/105737

PCT Pub. Date: May 23, 2024

(51) Int. Cl.
*F01N 3/023* (2006.01)
*F01N 11/00* (2006.01)

(52) U.S. Cl.
CPC ..... *F01N 3/023* (2013.01); *F01N 11/00* (2013.01); *F01N 2900/16* (2013.01)

(58) Field of Classification Search
CPC ..... F01N 3/023; F01N 11/00; F01N 2900/16
See application file for complete search history.

(56) References Cited

U.S. PATENT DOCUMENTS 8,141,413 B2 * 3/2012 Konstandopoulos ..... G01N 15/0618 73/23.31

FOREIGN PATENT DOCUMENTS

| | | | |
|---|---|---|---|
| JP | 2022-059817 | A | 4/2022 |
| KR | 2003-0030699 | A | 4/2003 |
| KR | 10-0679939 | B1 | 2/2007 |

OTHER PUBLICATIONS

International Search Report received in PCT Application No. PCT/JP2022/042260, dated Jan. 24, 2023.
Office Action dated Aug. 27, 2024 from corresponding Japan Application No. 2023-580929, 4 pages.

* cited by examiner

*Primary Examiner* — Brandon D Lee
(74) *Attorney, Agent, or Firm* — Rimon P.C.

(57) ABSTRACT

An exhaust gas purification device includes a filter to be provided in an exhaust passage coupled to an engine, a rotary vane to be provided downstream of the filter in the exhaust passage, and a control device including one or more processors and one or more memories coupled to the one or more processors. The one or more processors are configured to execute, based on a rotational speed of the rotary vane, processing including one or more of estimation processing of estimating an accumulation amount of particulate matter in the filter and regeneration processing of regenerating the filter.

7 Claims, 11 Drawing Sheets

EXHAUST GAS PURIFICATION DEVICE

CROSS-REFERENCE TO RELATED APPLICATIONS

This application is the U.S. National Phase under 35 U.S.C. § 371 of International Application No. PCT/JP2022/042260, filed on Nov. 14, 2022.

TECHNICAL FIELD

The present invention relates to an exhaust gas purification device to be provided in a vehicle.

BACKGROUND

Exhaust gas discharged from an engine contains particulate matter such as soot. Therefore, a vehicle is provided with a diesel particulate filter (DPF) or a gasoline particulate filter (GPF) as a filter for removing the particulate matter. In such a filter, the particulate matter is removed from the exhaust gas by capturing the particulate matter in pores formed in the filter. As the filter continues to be used, the filter is clogged with the particulate matter.

Therefore, for example, a technique is widely used in which an accumulation amount of the particulate matter in the filter is estimated based on a difference in pressure between pressures in front of and behind the filter, as illustrated in Patent Document 1. In this technique, when the difference in pressure increases to a predetermined pressure threshold value, it is estimated that the accumulation amount of the particulate matter in the filter has increased to a predetermined amount threshold value, and regeneration processing is executed on the filter. The regeneration processing is processing of supplying air to the filter to burn the particulate matter and remove the particulate matter from the filter.

CITATION LIST

Patent Literature

Patent Document 1: Japanese Unexamined Patent Application Publication No. 2022-59817

SUMMARY

Technical Problem

However, the difference in pressure between pressures in front of and behind the filter varies depending on not only the accumulation amount of the particulate matter in the filter but also an accumulation distribution. Therefore, in the filter, the difference in pressure may be less than the pressure threshold value even though the accumulation amount of the particulate matter is equal to or greater than the amount threshold value. Also, the difference in pressure may be equal to or greater than the pressure threshold value even though the accumulation amount of the particulate matter is less than the amount threshold value.

In a case of an accumulation distribution in which the difference in pressure is less than the pressure threshold value even though the accumulation amount of the particulate matter is equal to or greater than the amount threshold value, the accumulation amount of the particulate matter already far exceeds the amount threshold value when the difference in pressure reaches the pressure threshold value.

Therefore, executing the regeneration processing when the difference in pressure reaches the pressure threshold value may cause abnormal combustion of the particulate matter.

On the other hand, in a case of an accumulation distribution in which the difference in pressure is equal to or greater than the pressure threshold value even though the accumulation amount of the particulate matter is less than the amount threshold value, the accumulation amount of the particulate matter is still less than the amount threshold value even when the difference in pressure reaches the pressure threshold value. Therefore, even when the filter is not clogged, the regeneration processing is unnecessarily executed when the difference in pressure reaches the pressure threshold value.

Therefore, the regeneration processing may not be executed at an appropriate timing when the accumulation amount is estimated based on the difference in pressure between pressures in front of and behind the filter.

Therefore, an object of the present invention is to provide an exhaust gas purification device capable of executing regeneration processing at an appropriate timing based on a reference other than the difference in pressure between pressures in front of and behind the filter.

Solution to Problem

In order to solve the above problem, an exhaust gas purification device according to an embodiment of the present invention includes: a filter to be provided in an exhaust passage coupled to an engine; a rotary vane to be provided downstream of the filter in the exhaust passage; and a control device including one or more processors and one or more memories coupled to the one or more processors. The one or more processors are configured to execute, based on a rotational speed of the rotary vane, processing including one or more of estimation processing of estimating an accumulation amount of particulate matter in the filter and regeneration processing of regenerating the filter.

Advantageous Effects of Invention

According to the present invention, it is possible to execute regeneration processing at an appropriate timing based on a reference other than the difference in pressure between pressures in front of and behind the filter.

DESCRIPTION OF EMBODIMENTS

An embodiment of the present invention will be described in detail below with reference to the accompanying drawings. Dimensions, materials, numerical values, and the like illustrated in the embodiment are merely examples to facilitate understanding and are not intended to limit the invention unless otherwise stated. Note that in the present specification and the drawings, redundant descriptions with respect to elements having substantially the same function and configuration are omitted because the same reference signs will be used, and elements that are not directly related to the embodiment of the present invention are omitted from the drawings.

Figure 1:
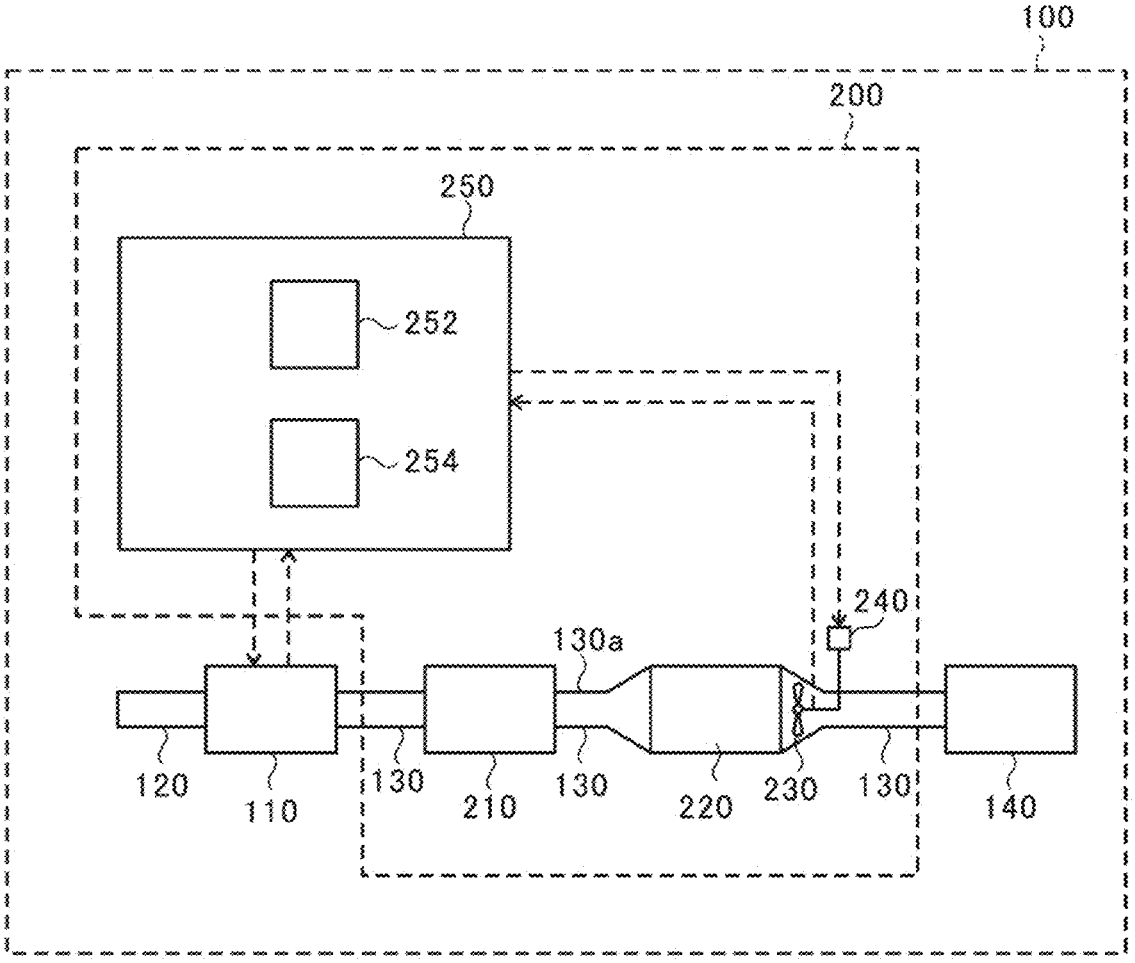
FIG. 1 is a schematic view illustrating a configuration of a vehicle according to an embodiment of the present invention.

FIG. 1 is a schematic view illustrating a configuration of a vehicle 100 according to an embodiment of the present invention. Note that in FIG. 1, dashed arrows indicate the flow of signals.

As illustrated in FIG. 1, the vehicle 100 according to the present embodiment includes an engine 110, an intake passage 120, an exhaust passage 130, a muffler 140, and an exhaust gas purification device 200.

The vehicle 100 includes the engine 110 as a drive source. The engine 110 is a gasoline engine. However, the vehicle according to the present invention is not limited to this example. For example, the vehicle may be a hybrid vehicle including a motor as a drive source in addition to the engine 110.

An intake manifold communicates with an intake port of the engine 110. The intake passage 120 communicates with a collecting portion of the intake manifold. The intake passage 120 is constituted by, for example, a pipe.

An exhaust manifold communicates with an exhaust port of the engine 110. The exhaust passage 130 communicates with a collecting portion of the exhaust manifold. The exhaust passage 130 is constituted by, for example, a pipe. The exhaust gas discharged from the engine 110 flows through the exhaust passage 130. Hereinafter, the upstream in the flow direction of the exhaust gas may be simply referred to as "upstream". Further, the downstream in the flow direction of the exhaust gas may be simply referred to as "downstream".

The exhaust passage 130 is provided with the exhaust gas purification device 200 and the muffler 140. The exhaust gas purification device 200 is provided between the engine 110 and the muffler 140 in the exhaust passage 130. The exhaust gas purification device 200 purifies exhaust gas discharged from the engine 110. The exhaust gas purified by the exhaust gas purification device 200 is discharged to the outside through the muffler 140.

Next, the configuration and function of the exhaust gas purification device 200 will be described in detail.

Exhaust Gas Purification Device 200

As illustrated in FIG. 1, the exhaust gas purification device 200 includes a catalyst device 210, a filter 220, a rotary vane 230, a motor 240, and a control device 250.

The catalyst device 210 is provided between the engine 110 and the muffler 140 in the exhaust passage 130. The catalyst device 210 includes, for example, a three-way catalyst. The three-way catalyst is, for example, a catalyst metal such as platinum (Pt), palladium (Pd), or rhodium (Rh). The catalyst device 210 removes hydrocarbon, carbon monoxide, and nitrogen oxides in the exhaust gas discharged from the engine 110.

The filter 220 is provided downstream of the catalyst device 210 in the exhaust passage 130. In other words, the filter 220 is provided between the catalyst device 210 and the muffler 140 in the exhaust passage 130. The filter 220 has, for example, a cylindrical shape. The filter 220 is disposed coaxially with an exhaust passage 130*a* coupled to the upstream side of the filter 220.

In the present embodiment, the filter 220 is, for example, a gasoline particulate filter (GPF). The filter 220 captures particulate matter contained in the exhaust gas. The particulate matter includes, for example, soot. The filter 220 is, for example, a wall-flow filter.

The rotary vane 230 is provided downstream of the filter 220 in the exhaust passage 130. In the present embodiment, the rotary vane 230 is passively rotatable by the flow of the exhaust gas flowing through the exhaust passage 130. The rotary vane 230 can also be actively rotated by the motor 240 to be described below.

In the present embodiment, the rotation axis of the rotary vane 230 is coaxial with, for example, the central axis of the cylindrical filter 220. That is, the central axis of the exhaust passage 130*a*, the central axis of the filter 220, and the rotation axis of the rotary vane 230 are disposed on the same line. This increases the correlation between the rotational speed of the rotary vane 230 rotated by the exhaust gas having passed through the filter 220, and the accumulation distribution and the accumulation amount of the particulate matter accumulated on the filter 220, making it possible to estimate the accumulation amount with higher accuracy.

The motor 240 rotates the rotary vane 230. In the present embodiment, when the regeneration processing of the filter 220 is executed, the motor 240 is coupled to the rotary vane 230 to rotate the rotary vane 230. When the rotary vane 230 is rotated by the motor 240, the flow rate of the gas flowing through the filter 220 can be increased.

When the regeneration processing of the filter 220 is not executed, the coupling between the motor 240 and the rotary vane 230 is released, and the rotary vane 230 can be freely rotated by the flow of the exhaust gas. When the regeneration processing of the filter 220 is not executed, the operation of the motor 240 is stopped.

The control device 250 includes one or more processors 252 and one or more memories 254 coupled to the processors 252. The processor 252 includes, for example, a central processing unit (CPU). The memory 254 includes, for example, a read only memory (ROM) and a random access memory (RAM). The ROM is a storage element that stores programs, operation parameters, and the like used by the CPU. The RAM is a storage element that temporarily stores data such as variables and parameters used for the processing executed by the CPU.

The control device 250 performs communication with each device (for example, the engine 110, the rotary vane 230, and the motor 240) provided in the vehicle 100. Communication between the control device 250 and each device is realized by using, for example, controller area network (CAN) communication.

Figure 2:
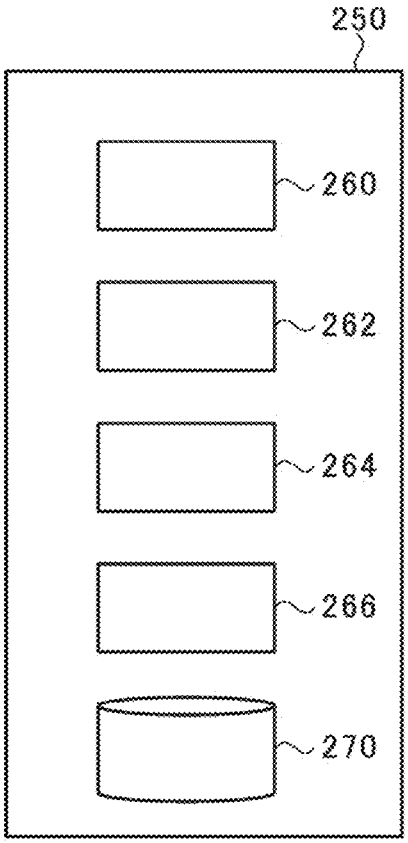
FIG. 2 is a block diagram illustrating an example of a functional configuration of a control device according to an embodiment of the present invention.

FIG. 2 is a block diagram illustrating an example of a functional configuration of the control device 250 according to an embodiment of the present invention. For example, as illustrated in FIG. 2, the control device 250 includes a signal acquisition unit 260, an accumulation amount estimator 262, an engine controller 264, a motor controller 266, and a storage 270. Note that various kinds of processing can be executed by the processor 252, including processing to be described below that is performed by the signal acquisition unit 260, the accumulation amount estimator 262, the engine controller 264, and the motor controller 266. Specifically, the processor 252 executes a program stored in the memory 254 to execute various kinds of processing.

The signal acquisition unit 260 acquires the rotational speed (the number of rotations) of the rotary vane 230. In the present embodiment, the signal acquisition unit 260 acquires the rotational speed of the rotary vane 230 when the regeneration processing for the filter 220 is not executed and the flow rate of the exhaust gas flowing through the exhaust passage 130 is in a steady state. Note that the steady state is a state in which the flow rate of the exhaust gas is substantially constant, for example, a change rate of the flow rate is within ±5%. The steady state is, for example, a state in which the flow rate of the exhaust gas is substantially constant during the warm-up operation of the engine 110.

The accumulation amount estimator 262 executes estimation processing of estimating the accumulation amount of the particulate matter in the filter 220 based on a transition of the rotational speed of the rotary vane 230. Here, the transition of the rotational speed of the rotary vane 230 is a temporal transition of the rotational speed of the rotary vane 230 when the rotational speed changes over time during the operation of the engine 110.

Figure 3:
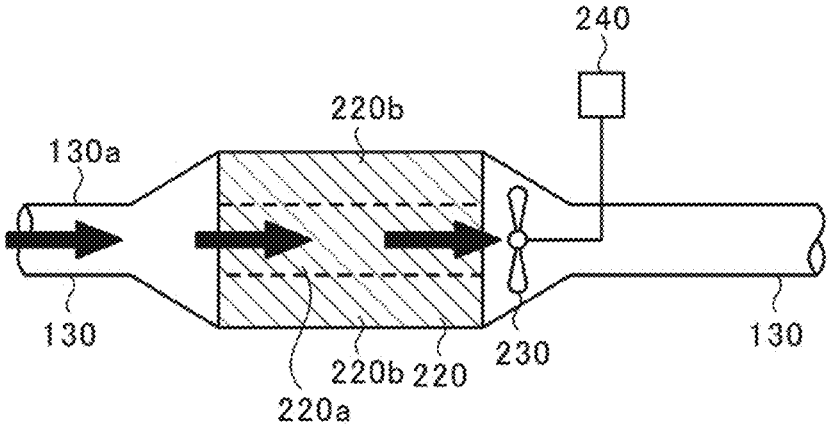
FIG. 3 is a first view illustrating a relationship between an accumulation distribution of particulate matter in a filter and a flow of exhaust gas passing through the filter according to an embodiment of the present invention.
Figure 4:
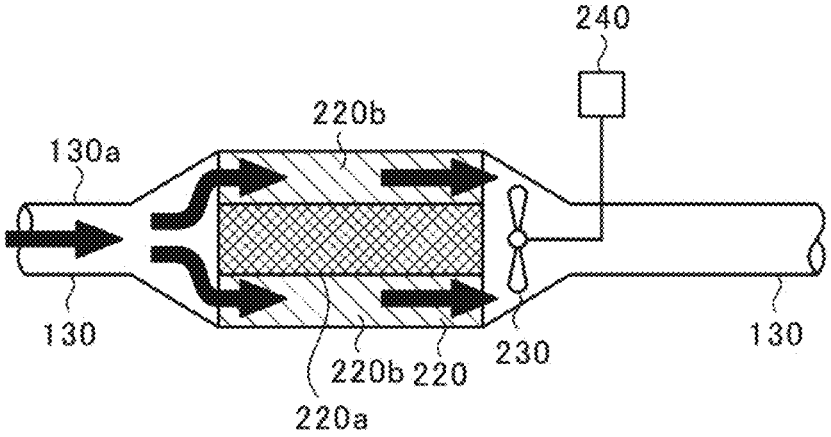
FIG. 4 is a second view illustrating the relationship between the accumulation distribution of the particulate matter in the filter and the flow of the exhaust gas passing through the filter according to an embodiment of the present invention.
Figure 5:
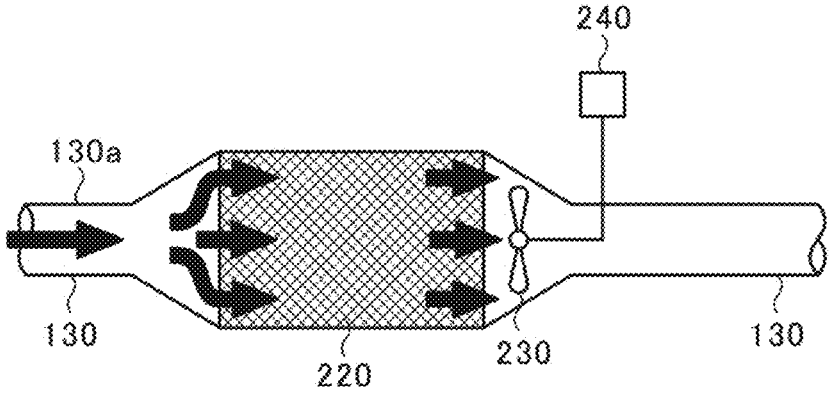
FIG. 5 is a third view illustrating the relationship between the accumulation distribution of the particulate matter in the filter and the flow of the exhaust gas passing through the filter according to an embodiment of the present invention.

FIGS. 3 to 5 are views illustrating a relationship between the accumulation distribution of the particulate matter in the filter 220 and the flow of the exhaust gas passing through the filter 220 according to an embodiment of the present invention. Note that in FIGS. 3 to 5, a region with one-directional hatching lines indicates a region where the particulate matter is not accumulated, and a cross-hatched region indicates a region where the particulate matter is accumulated. In FIGS. 3 to 5, arrows indicate the flow of the exhaust gas.

As described above, the central axis of the exhaust passage 130*a* and the central axis of the filter 220 are disposed on the same line. Therefore, in a first state in which almost no particulate matter is accumulated in the entire region of the filter 220, the exhaust gas supplied from the exhaust passage 130*a* to the filter 220 flows straight through a central region 220*a* including the central axis of the filter 220, as illustrated in FIG. 3. The filter 220 in the first state is a new filter 220 or a filter 220 that has been subjected to the regeneration processing. The particulate matter is captured in a region of the filter 220 through which the exhaust gas has passed. Therefore, the particulate matter is first accumulated in the central region 220*a* of the filter 220.

On the other hand, a magnitude of a pressure loss of the filter 220 depends on the accumulation amount of the particulate matter. In one example, in the filter 220, the pressure loss increases as the accumulation amount of the particulate matter increases. Therefore, the exhaust gas supplied from the exhaust passage 130*a* to the filter 220 preferentially flows through the region where the accumulation amount is small rather than the region where the accumulation amount is large. Therefore, as illustrated in FIGS. 3 to 5, as the operational time of the engine 110 elapses from the first state, the region where the particulate matter is accumulated is expanded from the central region 220*a* of the filter 220 toward an outer peripheral region 220*b*.

Next, the flow of the exhaust gas passing through the filter 220 and the rotational speed of the rotary vane 230 will be described.

As illustrated in FIG. 3, in the first state where almost no particulate matter is accumulated on the filter 220, the exhaust gas flowing through the exhaust passage 130*a* travels substantially straight, passes through the central region 220*a* of the filter 220, and reaches the rotary vane 230. Therefore, the exhaust gas mainly hits the rotation axis (central portion) of the rotary vane 230 and the vicinity of the rotation axis.

Then, as the operational time of the engine 110 elapses from the first state, the accumulation amount of the particulate matter on the filter 220 increases, and the filter 220 transitions from the first state to a second state.

As illustrated in FIG. 4, when the filter 220 is in the second state, the particulate matter is accumulated in the central region 220*a* that includes the central axis of the filter 220. As described above, the pressure loss is large in the region where the particulate matter is accumulated. For this reason, the exhaust gas preferentially flows through the outer peripheral region 220*b* where the particulate matter is not accumulated rather than the central region 220*a* where the particulate matter is accumulated. Therefore, the exhaust gas mainly hits the outer peripheral portion of the rotary vane 230 and the vicinity of the outer peripheral portion.

A torque T for rotating the rotary vane 230 depends on a force F acting on the rotary vane 230 and a distance L from the position of the rotary vane 230 on which the force Facts to the rotation axis ($T=F\times L$). The flow rate of the exhaust gas acting on the rotary vane 230 corresponds to the "force F" described above. The distance from the position at which the exhaust gas hits the rotary vane 230 to the rotation axis corresponds to the "distance L" described above. Therefore, the rotational speed of the rotary vane 230 depends on the flow rate of the exhaust gas acting on the rotary vane 230 and the distance from the position where the exhaust gas hits the rotary vane 230 to the rotation axis. Therefore, with the flow rate of the exhaust gas being substantially constant, the rotational speed of the rotary vane 230 is higher when the exhaust gas hits the outer peripheral portion of the rotary vane 230 than when the exhaust gas hits the central portion of the rotary vane 230. Therefore, when the filter 220 is in the second state, the rotational speed of the rotary vane 230 is higher than the rotational speed in the first state.

Then, as the operational time of the engine 110 elapses from the second state, the accumulation amount of the particulate matter on the filter 220 further increases, and the filter 220 transitions from the second state to a third state.

As illustrated in FIG. 5, when the filter 220 is in the third state, the particulate matter is accumulated in the entire region of the filter 220. Therefore, the exhaust gas passes through the entire filter 220. Therefore, the exhaust gas substantially uniformly hits the entire rotary vane 230. Then, when the filter 220 is in the third state, the rotational speed of the rotary vane 230 is lower than the rotational speed in the second state. Further, when the filter 220 is in the third state, the rotational speed of the rotary vane 230 is higher than the rotational speed in the first state.

Figure 6:
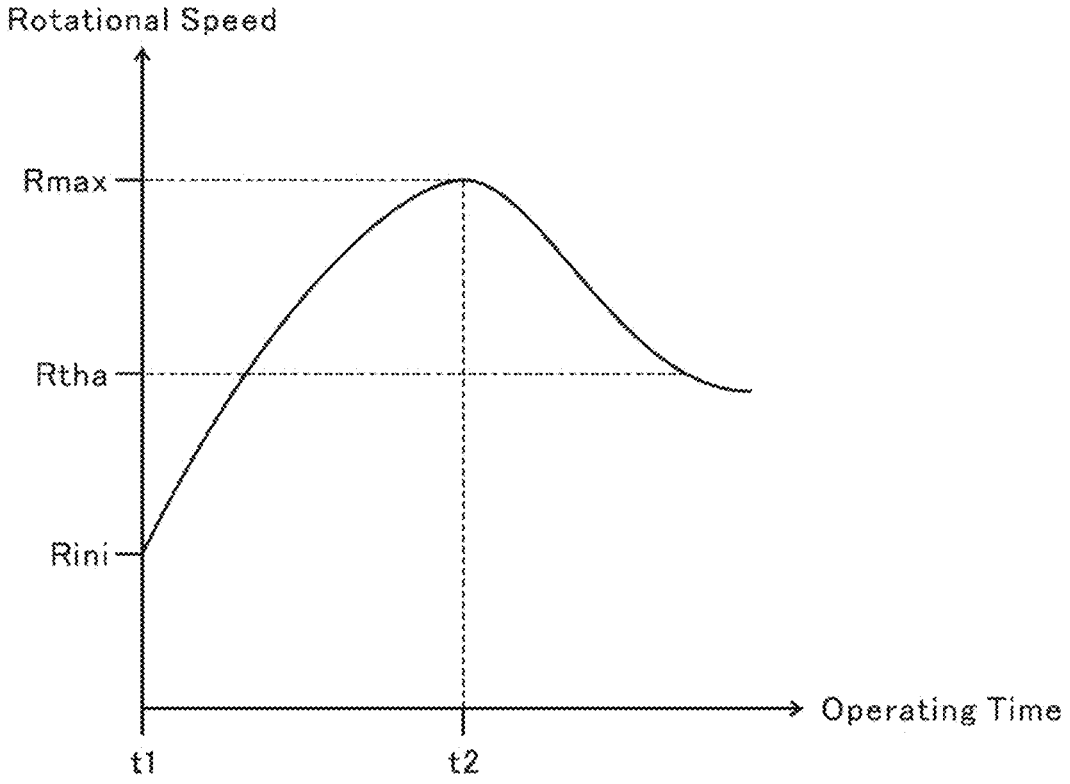
FIG. 6 is a view illustrating a relationship between an operational time of an engine and a rotational speed of a rotary vane according to an embodiment of the present invention.

FIG. 6 is a view illustrating the relationship between the operational time of the engine 110 and the rotational speed of the rotary vane 230 according to an embodiment of the present invention. In FIG. 6, the horizontal axis represents the operational time of the engine 110. In FIG. 6, the vertical axis represents the rotational speed of the rotary vane 230.

As illustrated in FIG. 6, for example, at a time t1 when the filter 220 is in the first state (see FIG. 3), the rotational speed of the rotary vane 230 is at a rotational speed Rini. As described above, when the operation of the engine 110 is continued from the first state, the region where the particulate matter is accumulated is expanded from the central region 220*a* of the filter 220 toward the outer peripheral region 220*b*. Therefore, as the time elapses from the first state, the portion of the rotary vane 230 hit by the exhaust gas moves from the center to the outer periphery (tip) of the rotary vane 230. Therefore, as the time elapses from the first state, the rotational speed of the rotary vane 230 gradually increases from the rotational speed Rini.

Then, at a time t2 when the filter 220 is in the second state (see FIG. 4), the rotational speed of the rotary vane 230 is at the maximum rotational speed Rmax.

As the time further elapses from the time t2, the particulate matter is accumulated on the entire region of the filter 220, so that the exhaust gas hits the entire rotary vane 230. Therefore, after the time t2, the rotational speed of the rotary vane 230 gradually decreases from the rotational speed Rmax as the time elapses.

Referring back to FIG. 2, in the present embodiment, the accumulation amount estimator 262 refers to correlation information stored in the storage 270 to be described below, and executes the estimation processing of estimating the accumulation amount of the particulate matter in the filter 220 based on the rotational speed of the rotary vane 230. Note that the correlation information is information indicating a correlation between the accumulation amount of the particulate matter in the filter 220 and the rotational speed of the rotary vane 230. The correlation information is created through an experiment or a simulation and stored in the storage 270 in advance.

The engine controller 264 controls the engine 110. In the present embodiment, when the accumulation amount of the particulate matter estimated by the accumulation amount estimator 262 becomes equal to or greater than a predetermined amount threshold value Tha, the engine controller 264 cuts off fuel to the engine 110, sends air to the filter 220, and executes the regeneration processing. Note that the amount threshold value Tha is the maximum value of the accumulation amount at which the particulate matter can be burned without abnormal combustion in the regeneration processing, and is determined accordingly. For example, the amount threshold value Tha is the accumulation amount of the particulate matter when, after reaching the rotational speed Rmax that is the maximum value, the rotational speed of the rotary vane 230 comes to the rotational speed Rtha as the change rate of the rotational speed keeps declining, and is determined accordingly (see FIG. 6). Information indicating the amount threshold value Tha is stored in the storage 270 in advance.

While the regeneration processing is being executed, the motor controller 266 couples the motor 240 to the rotary vane 230 and operates the motor 240.

The storage 270 stores the correlation information described above and information indicating the amount threshold value Tha.

Regeneration Method

Figure 7:
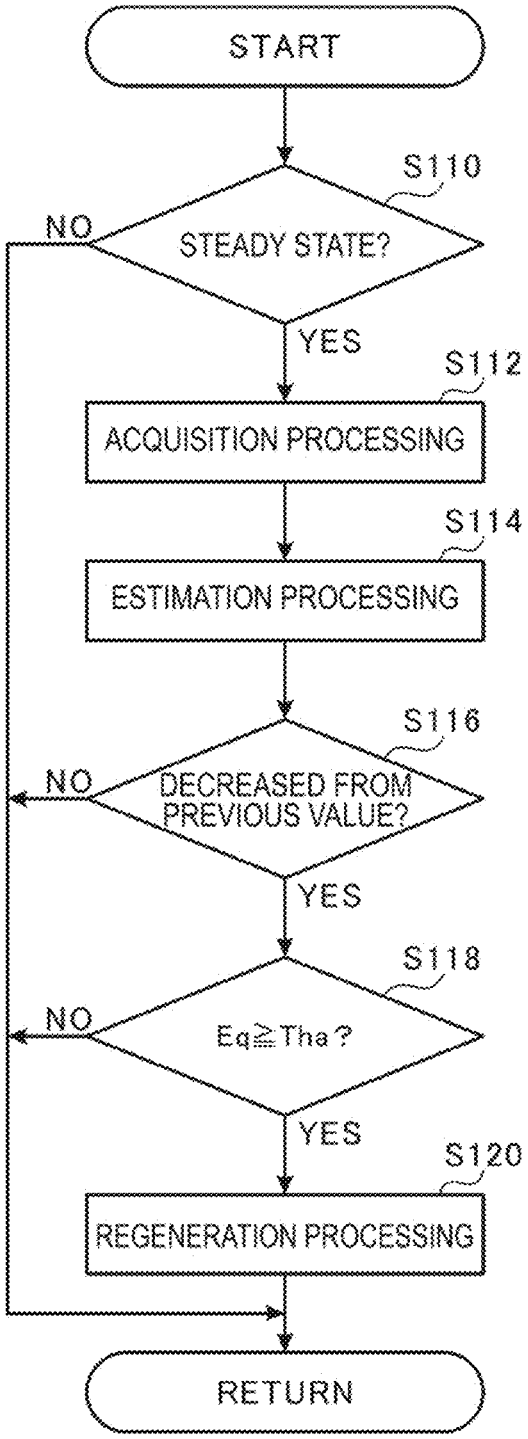
FIG. 7 is a flowchart illustrating a processing flow of a regeneration method of a filter 220 according to an embodiment of the present invention.

Next, a regeneration method of the filter 220 using the exhaust gas purification device 200 described above will be described. FIG. 7 is a flowchart illustrating a processing flow of a regeneration method of the filter 220 according to an embodiment of the present invention. As illustrated in FIG. 7, the regeneration method according to the present embodiment includes steady state determination processing S110, acquisition processing S112, estimation processing S114, decrease determination processing S116, accumulation amount determination processing S118, and regeneration processing S120. Hereinafter, each processing will be described. Note that in the present embodiment, the regeneration method is repeatedly performed upon interruptions generated at predetermined time intervals.

Steady State Determination Processing S110

The signal acquisition unit 260 determines whether the flow rate of the exhaust gas flowing through the exhaust passage 130 is in a steady state. As a result, if it is determined that the state is the steady state (YES in S110), the signal acquisition unit 260 shifts the processing to the acquisition processing S112. On the other hand, if it is determined that the state is not the steady state (NO in S110), the signal acquisition unit 260 ends the regeneration method.

Acquisition Processing S112

The signal acquisition unit 260 acquires the rotational speed R of the rotary vane 230.

Estimation Processing S114

The accumulation amount estimator 262 refers to the correlation information stored in the storage 270, and estimates the accumulation amount Eq of the particulate matter in the filter 220 based on the rotational speed R acquired in the acquisition processing S112.

Decrease Determination Processing S116

The engine controller 264 compares a previous value, which is the rotational speed R acquired in the previous acquisition processing S112, with a current value, which is the rotational speed R acquired in the current acquisition processing S112. Then, the engine controller 264 determines whether the rotational speed R acquired in the current acquisition processing S112 has decreased from the previous value. As a result, if it is determined that the rotational speed R has decreased from the previous value (YES in S116), the engine controller 264 shifts the processing to the accumulation amount determination processing S118. On the other hand, if it is determined that the rotational speed R has not decreased from the previous value (NO in S116), the engine controller 264 ends the regeneration method.

Accumulation Amount Determination Processing S118

The engine controller 264 determines whether the accumulation amount Eq estimated in the estimation processing S114 is equal to or greater than the amount threshold value Tha stored in the storage 270. As a result, if it is determined that the accumulation amount Eq is equal to or greater than the amount threshold value Tha (YES in S118), the engine controller 264 shifts the processing to the regeneration processing S120. On the other hand, if it is determined that the accumulation amount Eq is neither equal to nor greater than the amount threshold value Tha, that is, the accumulation amount Eq is less than the amount threshold value Tha (NO in S118), the engine controller 264 ends the regeneration method.

Regeneration Processing S120

The engine controller 264 cuts off fuel to the engine 110, sends air to the filter 220, and executes the regeneration processing. Further, the motor controller 266 couples the motor 240 to the rotary vane 230 and operates the motor 240.

As described above, the exhaust gas purification device 200 according to the present embodiment executes the estimation processing based on the transition of the rotational speed of the rotary vane 230. As described above, in an initial stage in which the particulate matter starts to be accumulated on the filter 220, the accumulation distribution of the particulate matter is not uneven in the filter 220 as illustrated in FIG. 3. Thereafter, the particulate matter is gradually accumulated from the central region 220*a* to the outer peripheral region 220*b* of the filter 220, and unevenness of the accumulation distribution is generated. Therefore, since the state changes from the first state (see FIG. 3) in which the exhaust gas mainly passes through the central region 220*a* of the filter 220 to the second state (see FIG. 4) in which the exhaust gas mainly passes through the outer peripheral region 220*b*, the rotational speed of the rotary vane 230 gradually increases from the initial rotational speed Rini until reaching the maximum rotational speed Rmax.

Then, in a middle stage in which the accumulation of the particulate matter has progressed to some extent, the second state is obtained in which the exhaust gas passes through the outermost outer peripheral region 220*b*, as illustrated in FIG. 4. Therefore, the rotational speed of the rotary vane 230 reaches the maximum rotational speed Rmax. Thereafter, in a later stage in which the accumulation of the particulate matter has further progressed, as illustrated in FIG. 5, the particulate matter is accumulated on the entire filter 220 without unevenness in the accumulation distribution. Therefore, the state is a third state in which the exhaust gas passes through the entire filter 220. In this manner, a transition takes place from the second state (see FIG. 4) in which the exhaust gas mainly passes through the outer peripheral region 220*b* to the third state (see FIG. 5) in which the exhaust gas passes through the entire region of the filter 220. Thus, the rotational speed of the rotary vane 230 gradually decreases from the maximum rotational speed Rmax and finally reaches the rotational speed Rtha corresponding to the state in which the regeneration processing of the filter 220 is to be executed. In this manner, the rotational speed of the rotary vane 230 changes based on the accumulation distribution and the accumulation amount of the particulate matter in the filter 220.

Therefore, the exhaust gas purification device 200 according to the present embodiment estimates the accumulation amount of the particulate matter in the filter 220 based on the transition (change with time) of the rotational speed of the rotary vane 230. As a result, the exhaust gas purification device 200 can estimate the accumulation amount with high accuracy as compared with the known technique. In the known technique, the accumulation amount is estimated based on the difference in pressure between pressures in front of and behind the filter 220. Therefore, the exhaust gas purification device 200 can execute the regeneration processing at an appropriate timing.

As described above, the exhaust gas purification device 200 executes the regeneration processing when, after increasing to the rotational speed Rmax (first rotational speed), the rotational speed of the rotary vane 230 decreases to the rotational speed Rtha (second rotational speed) that is lower than the rotational speed Rmax. As a result, the exhaust gas purification device 200 can execute the regeneration processing at a timing when the regeneration processing of the filter 220 is to be executed after the particulate matter is accumulated on the entire region of the filter 220. Therefore, the exhaust gas purification device 200 can avoid a situation in which the regeneration processing is executed before the regeneration processing of the filter 220 is to be executed.

Further, as described above, the signal acquisition unit 260 acquires the rotational speed of the rotary vane 230 when the flow rate of the exhaust gas flowing through the exhaust passage 130 is in the steady state (for example, during the warm-up operation of the engine 110). As a result, it is possible to eliminate the fluctuation in the rotational speed of the rotary vane 230 caused by the difference in the flow rate of the exhaust gas, and it is possible to detect the fluctuation in the rotational speed caused by the accumulation distribution and the accumulation amount of the particulate matter in the filter 220.

As described above, the exhaust gas purification device 200 includes the motor 240 and the motor controller 266. The motor 240 and the motor controller 266 rotate the rotary vane 230 while the regeneration processing is executed. As a result, the exhaust gas purification device 200 can increase the amount of fresh air (oxygen) supplied to the filter 220 while executing the regeneration processing. Therefore, the exhaust gas purification device 200 can efficiently execute the regeneration processing of the filter 220.

First Modification

In the above-described embodiment, an example has been described in which the exhaust gas purification device 200 executes the estimation processing of the accumulation amount based on the transition of the rotational speed of the rotary vane 230, and executes the regeneration processing of the filter 220 based on the estimated accumulation amount. However, the exhaust gas purification device 200 may execute the regeneration processing of the filter 220 based on the transition of the rotational speed of the rotary vane 230 without executing the estimation processing of the accumulation amount.

Figure 8:
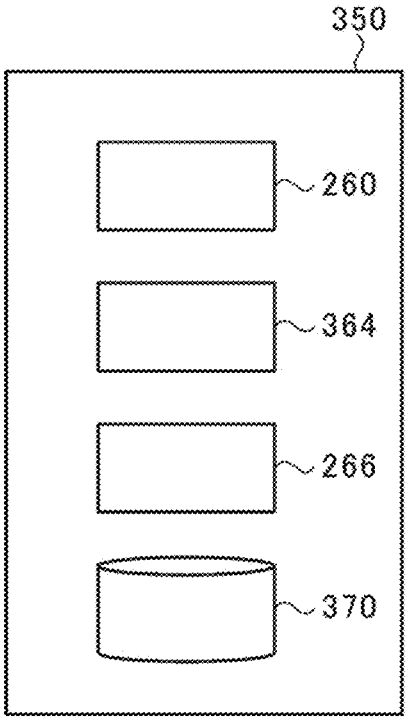
FIG. 8 is a block diagram illustrating an example of a functional configuration of a control device according to a first modification.

FIG. 8 is a block diagram illustrating an example of a functional configuration of a control device 350 according to a first modification. For example, as illustrated in FIG. 8, the control device 350 includes the signal acquisition unit 260, an engine controller 364, the motor controller 266, and a storage 370. Note that various kinds of processing can be executed by the processor 252, including processing to be described below performed by the signal acquisition unit 260, the engine controller 364, and the motor controller 266. Specifically, the processor 252 executes a program stored in the memory 254 to execute various kinds of processing. Note that constituent elements that are substantially the same as those of the control device 250 of the above-described embodiment are denoted by the same reference signs, and description thereof is omitted.

In the first modification, the engine controller 364 executes the regeneration processing based on the transition of the rotational speed of the rotary vane 230. Processing performed by the engine controller 364 will be described in detail below.

In the first modification, the storage 370 stores regeneration processing execution information. The regeneration processing execution information is information indicating the rotational speed Rtha of the rotary vane 230 in the case of the amount threshold value Tha. The regeneration processing execution information is created through an experiment or a simulation and is stored in the storage 370 in advance.

Figure 9:
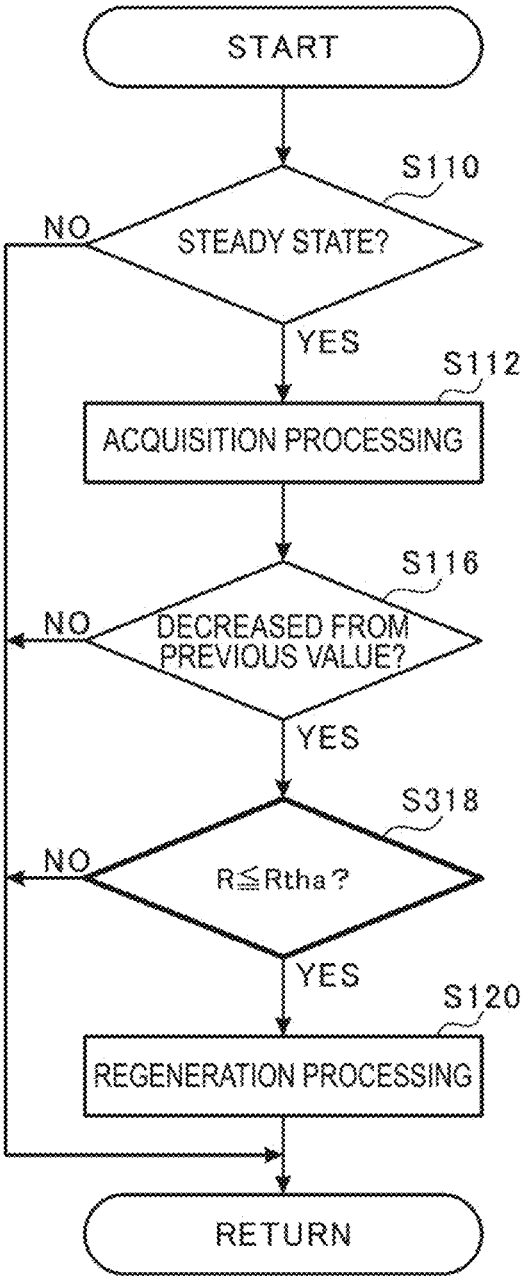
FIG. 9 is a flowchart illustrating a processing flow of a regeneration method of a filter according to the first modification.

Next, a regeneration method of the filter 220 according to the first modification will be described. FIG. 9 is a flowchart illustrating a processing flow of a regeneration method of the filter 220 according to the first modification. As illustrated in FIG. 9, the regeneration method according to the first modification includes the steady state determination processing S110, the acquisition processing S112, the decrease determination processing S116, rotational speed determination processing S318, and the regeneration processing S120. Hereinafter, each processing will be described. Note that in the first modification, the regeneration method is repeatedly performed upon interruptions generated at predetermined time intervals. Further, substantially the same processing as that of the regeneration method of the above-described embodiment are denoted by the same reference signs, and the description thereof will be omitted.

Rotational Speed Determination Processing S318

If it is determined that the current value of the rotational speed R has decreased from the previous value (YES in S116), the engine controller 364 determines whether the rotational speed R acquired in the acquisition processing S112 is equal to or lower than the rotational speed Rtha. As a result, if it is determined that the rotational speed R is equal to or lower than the rotational speed Rtha (YES in S318), the engine controller 364 shifts the processing to the regeneration processing S120. On the other hand, if it is determined that the rotational speed R is neither equal to nor lower than the rotational speed Rtha, that is, the rotational speed R is higher than the rotational speed Rtha (NO in S318), the engine controller 364 ends the regeneration method.

As described above, in the first modification, the exhaust gas purification device 200 executes the regeneration processing based on the transition of the rotational speed of the rotary vane 230. As described above, the rotational speed of the rotary vane 230 changes based on the accumulation distribution and the accumulation amount of the particulate matter in the filter 220.

Therefore, in the first modification, the exhaust gas purification device 200 can execute the regeneration processing at an appropriate timing by executing the regeneration processing based on the transition (change with time) of the rotational speed of the rotary vane 230, as compared with the known technique. In the known technique, the regeneration processing is executed based on the difference in pressure between pressures in front of and behind the filter 220.

Further, in the first modification, the control device 350 does not estimate the accumulation amount of the particulate matter in the filter 220 unlike the control device 250 of the above-described embodiment. Therefore, in the first modification, the control device 350 can reduce the processing load.

Second Modification

In the above-described embodiment, an example has been described in which the exhaust gas purification device 200 executes the estimation processing of the accumulation amount based on the transition of the rotational speed of the rotary vane 230. However, the exhaust gas purification device 200 may execute the estimation processing of the accumulation amount based on the rotational speed itself of the rotary vane 230.

Figure 10:
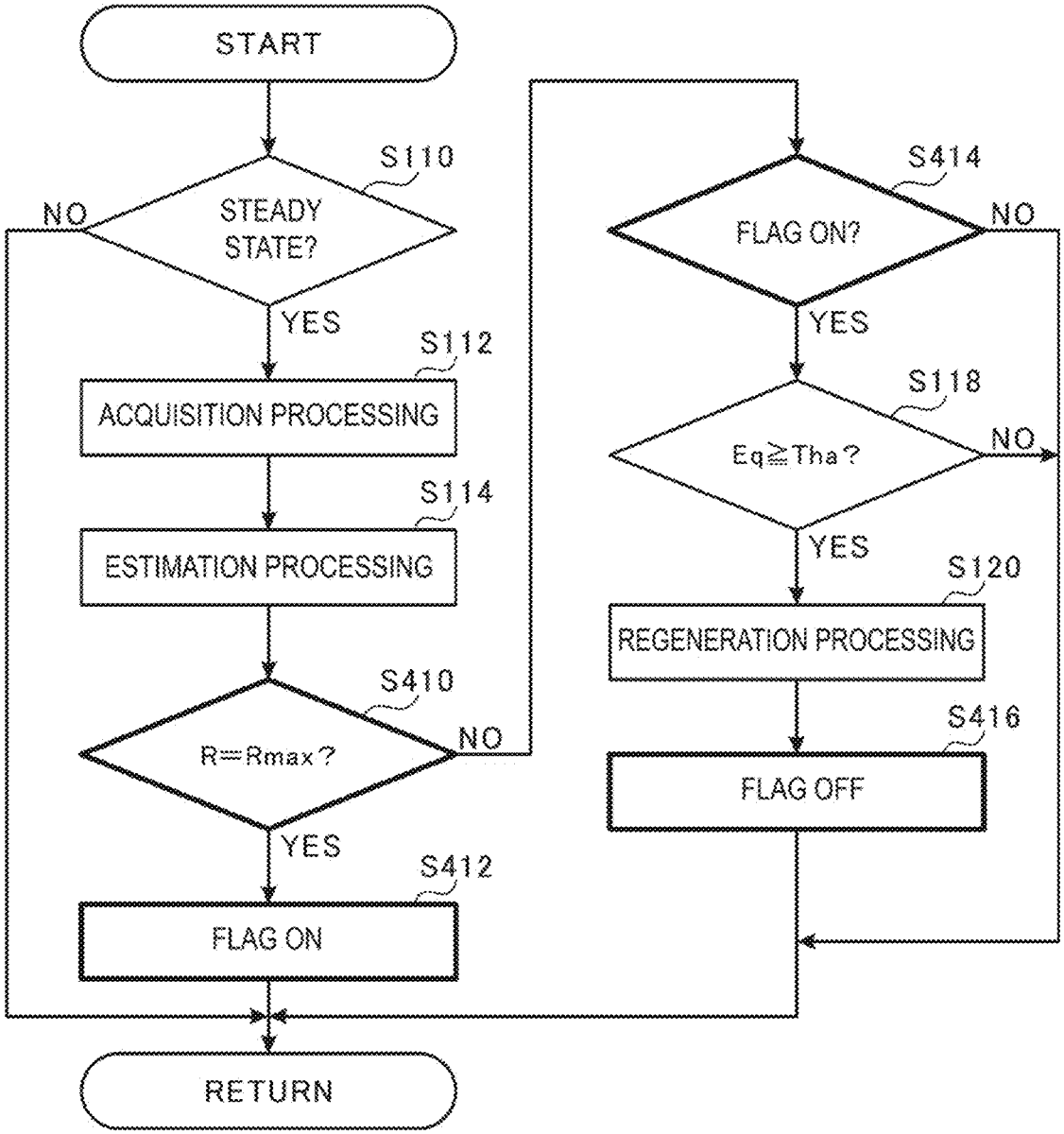
FIG. 10 is a flowchart illustrating a processing flow of a regeneration method of a filter according to a second modification.

FIG. 10 is a flowchart illustrating a processing flow of a regeneration method of the filter 220 according to the second modification. As illustrated in FIG. 10, the regeneration method according to the second modification includes the steady state determination processing S110, the acquisition processing S112, the estimation processing S114, rotational speed determination processing S410, flag ON processing S412, flag determination processing S414, the accumulation amount determination processing S118, the regeneration processing S120, and flag OFF processing S416. Hereinafter, each processing will be described. Note that in the second modification, the regeneration method is repeatedly performed upon interruptions generated at predetermined time intervals. Further, substantially the same processing as that of the regeneration method of the above-described embodiment are denoted by the same reference signs, and the description thereof will be omitted.

Rotational Speed Determination Processing S410

The engine controller 264 determines whether the rotational speed R acquired in the acquisition processing S112 is at the rotational speed Rmax (first rotational speed). As a result, if it is determined that the rotational speed R is at the rotational speed Rmax (YES in S410), the engine controller 264 shifts the processing to the flag ON processing S412. On the other hand, if it is determined that the rotational speed R is not at the rotational speed Rmax, that is, the rotational speed R is less than the rotational speed Rmax (NO in S410), the engine controller 264 shifts the processing to the flag determination processing S414.

Flag On Processing S412

The engine controller 264 turns on a flag indicating that the rotational speed R of the rotary vane 230 has reached the rotational speed Rmax. Note that when the rotational speed R of the rotary vane 230 is less than the rotational speed Rmax, the flag is OFF.

Flag Determination Processing S414

The engine controller 264 determines whether the flag is ON. As a result, if it is determined that the flag is ON (YES in S414), the engine controller 264 shifts the processing to the accumulation amount determination processing S118. On the other hand, if the flag is not ON, that is, the flag is OFF (NO in S414), the engine controller 264 ends the regeneration method.

Flag Off Processing S416

When the regeneration processing S120 is executed, the engine controller 264 turns off the flag.

As described above, in the second modification, the exhaust gas purification device 200 executes the estimation processing based on the rotational speed itself of the rotary vane 230. As described above, the rotational speed of the rotary vane 230 changes based on the accumulation distribution and the accumulation amount of the particulate matter in the filter 220.

Therefore, in the second modification, the exhaust gas purification device 200 estimates the estimated amount of the particulate matter in the filter 220 based on the rotational speed of the rotary vane 230. As a result, the exhaust gas purification device 200 can estimate the accumulation amount with high accuracy as compared with the known technique. In the known technique, the accumulation amount is estimated based on the difference in pressure between pressures in front of and behind the filter 220.

Third Modification

In the second modification, an example has been described in which the exhaust gas purification device 200 executes the estimation processing of the accumulation amount based on the rotational speed itself of the rotary vane 230, and executes the regeneration processing of the filter 220 based on the estimated accumulation amount. However, the exhaust gas purification device 200 may execute the regeneration processing of the filter 220 based on the rotational speed itself of the rotary vane 230 without executing the estimation processing of the accumulation amount.

Figure 11:
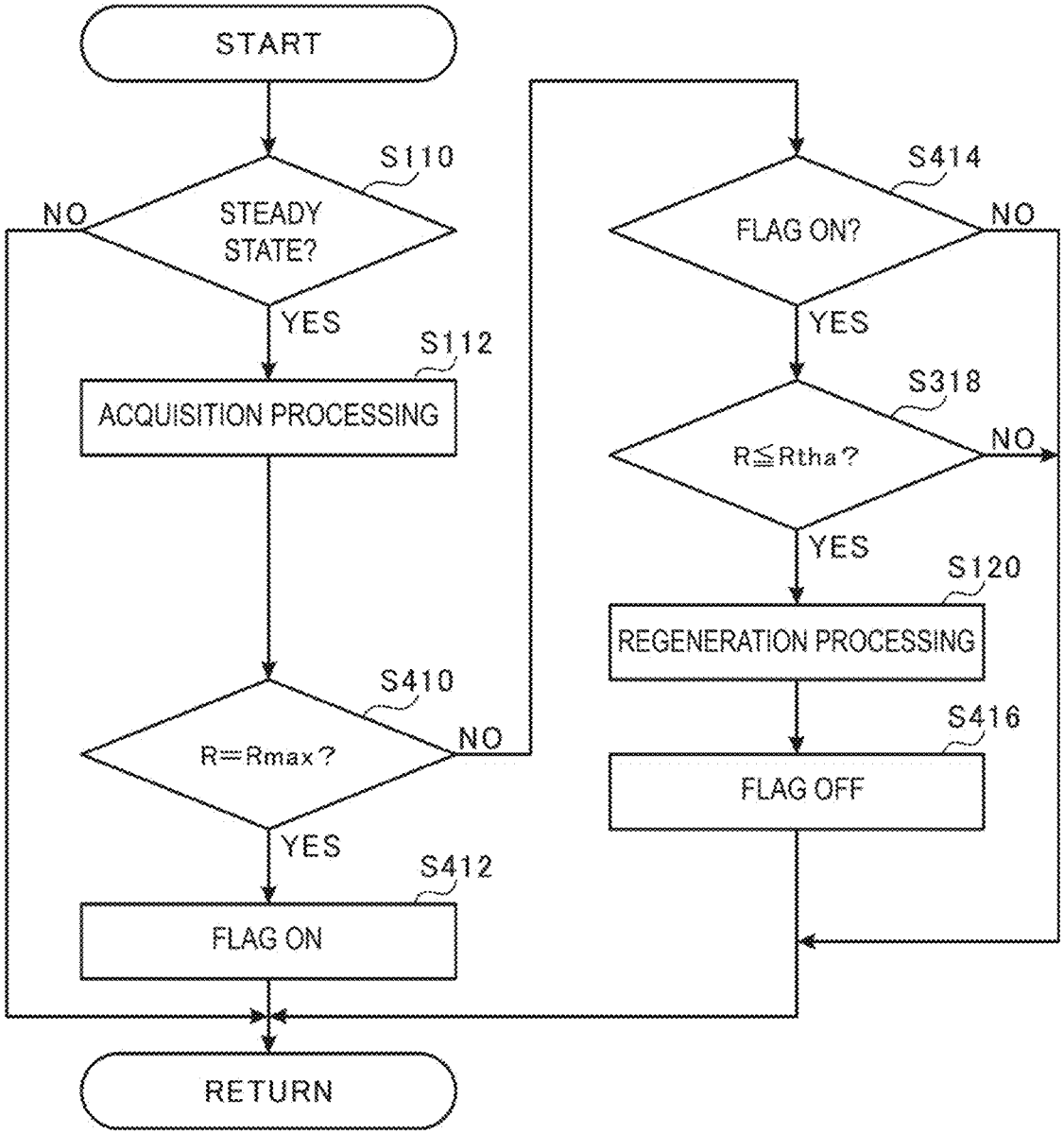
FIG. 11 is a flowchart illustrating a processing flow of a regeneration method of a filter according to a third modification.

FIG. 11 is a flowchart illustrating a processing flow of a regeneration method of the filter 220 according to the third modification. As illustrated in FIG. 11, the regeneration method according to the third modification includes the steady state determination processing S110, the acquisition processing S112, the rotational speed determination processing S410, the flag ON processing S412, the flag determination processing S414, the rotational speed determination processing S318, the regeneration processing S120, and the flag OFF processing S416. Note that in the third modification, the regeneration method is repeatedly performed upon interruptions generated at predetermined time intervals. In addition, substantially the same processing as those of the regeneration methods of the above-described embodiment, the first modification, and the second modification are denoted by the same reference signs, and the description thereof will be omitted.

In the third modification, the exhaust gas purification device 200 executes the regeneration processing based on the rotational speed itself of the rotary vane 230. As described above, the rotational speed of the rotary vane 230 changes based on the accumulation distribution and the accumulation amount of the particulate matter in the filter 220.

Therefore, in the third modification, the exhaust gas purification device 200 can execute the regeneration processing at an appropriate timing by executing the regeneration processing based on the rotational speed of the rotary vane 230, as compared with the known technique. In the known technique, the regeneration processing is executed based on the difference in pressure between pressures in front of and behind the filter 220.

Further, in the third modification, the control device 350 does not estimate the accumulation amount of the particulate matter in the filter 220 unlike the control device 250 of the second modification. Therefore, in the third modification, the control device 350 can reduce the processing load.

A preferred embodiment of the present invention has been described above with reference to the accompanying drawings, but the present invention is not limited to such an embodiment. It is apparent to those skilled in the art that various modifications and variations may be conceived in the scope of the claims, and it is thus acknowledged that those modifications and variations are also naturally included in the technical scope of the present invention.

For example, in the above-described embodiment and the first to third modifications, examples have been described in which the exhaust gas purification device 200 executes the estimation processing or the regeneration processing based on the rotational speed of the rotary vane 230 when the flow rate of the exhaust gas flowing through the exhaust passage 130 is in the steady state. However, the exhaust gas purification device 200 may execute the estimation processing or the regeneration processing based on the correction value obtained by correcting the rotational speed of the rotary vane 230 with the flow rate of the exhaust gas flowing through the exhaust passage 130. By executing the estimation processing or the regeneration processing based on the correction value, the exhaust gas purification device 200 can eliminate the fluctuation in the rotational speed of the rotary vane 230 caused by the difference in the flow rate of the exhaust gas, and can execute the estimation processing or the regeneration processing based on the rotational speed caused by the accumulation distribution and the accumulation amount of the particulate matter in the filter 220. Therefore, the exhaust gas purification device 200 can improve the estimation accuracy of the accumulation amount and the determination accuracy of the timing to execute the regeneration processing.

In the above-described embodiment and the second and third modifications, the rotational speed Rmax has been described as an example of the first rotational speed. The rotational speed Rmax is the maximum rotational speed of the rotary vane 230. However, the first rotational speed may be a value lower than the rotational speed Rmax and higher than the rotational speed Rtha. In this case, the exhaust gas purification device 200 may execute the regeneration processing or the estimation processing when, after increasing to the first rotational speed or higher, the rotational speed of the rotary vane 230 decreases to the second rotational speed or lower, the second rotational speed being lower than the first rotational speed. In the above-described embodiment and the first to third modifications, the rotational speed Rtha has been described as an example of the second rotational speed. The rotational speed Rtha corresponds to the state in which the regeneration processing of the filter 220 is to be executed. However, the second rotational speed may be a value lower than the first rotational speed and higher than the rotational speed Rtha.

Further, in the above-described embodiment and the second modification, examples have been described in which the exhaust gas purification device 200 constantly executes the estimation processing. However, the exhaust gas purification device 200 may execute the estimation processing when, after increasing to the first rotational speed or higher, the rotational speed of the rotary vane 230 decreases to the second rotational speed or lower, the second rotational speed being lower than the first rotational speed. Thus, the exhaust gas purification device 200 may execute the estimation processing only for a predetermined period before and after the start of the execution of the regeneration processing. Therefore, the control devices 250 and 350 can reduce the calculation load for the estimation processing.

In the above-described embodiment and the first to third modifications, examples have been described in which the filter 220 is employed as a GPF. However, the filter 220 may be employed as a diesel particulate filter (DPF). That is, the engine 110 may be a diesel engine.

REFERENCE SIGNS LIST

200 Exhaust gas purification device
220 Filter
230 Rotary vane
250 Control device
350 Control device

The invention claimed is:

1. An exhaust gas purification device comprising:

a filter to be provided in an exhaust passage coupled to an engine;

a rotary vane to be provided downstream of the filter in the exhaust passage; and a control device comprising one or more processors and one or more memories coupled to the one or more processors, wherein the one or more processors are configured to execute, based on a rotational speed of the rotary vane, processing comprising one or both of estimation processing of estimating an accumulation amount of particulate matter in the filter and regeneration processing of regenerating the filter.

2. The exhaust gas purification device according to claim 1, wherein the one or more processors are configured to execute, based on a transition of the rotational speed of the rotary vane, execute the estimation processing or the regeneration processing.

3. The exhaust gas purification device according to claim 2, wherein the one or more processors are configured to execute the estimation processing or the regeneration processing when, as an operational time of the engine elapses, the rotational speed of the rotary vane increases to a first rotational speed or higher and then decreases to a second rotational speed or lower the second rotational speed being lower than the first rotational speed.

4. The exhaust gas purification device according to claim 1, wherein the one or more processors are configured to execute the estimation processing or the regeneration processing, based on the rotational speed of the rotary vane when a flow rate of an exhaust gas flowing through the exhaust passage is in a steady state.

5. The exhaust gas purification device according to claim 1, wherein the one or more processors are configured to execute the estimation processing or the regeneration processing, based on a correction value obtained by correcting the rotational speed of the rotary vane with a flow rate of an exhaust gas flowing through the exhaust passage.

6. The exhaust gas purification device according to claim 2, wherein the one or more processors are configured to execute the estimation processing or the regeneration processing, based on the rotational speed of the rotary vane when a flow rate of an exhaust gas flowing through the exhaust passage is in a steady state.

7. The exhaust gas purification device according to claim 2, wherein the one or more processors are configured to execute the estimation processing or the regeneration processing, based on a correction value obtained by correcting the rotational speed of the rotary vane with a flow rate of an exhaust gas flowing through the exhaust passage.

* * * * *